US008085222B2

(12) United States Patent
Okada et al.

(10) Patent No.: US 8,085,222 B2
(45) Date of Patent: Dec. 27, 2011

(54) PLASMA DISPLAY DEVICE AND METHOD FOR DRIVING THE SAME

(75) Inventors: Taku Okada, Osaka (JP); Minoru Takeda, Osaka (JP); Yohei Koshio, Osaka (JP); Shinichiro Hashimoto, Osaka (JP); Kenji Ogawa, Osaka (JP)

(73) Assignee: Panasonic Corporation, Osaka (JP)

( * ) Notice: Subject to any disclaimer, the term of this patent is extended or adjusted under 35 U.S.C. 154(b) by 207 days.

(21) Appl. No.: 12/296,299

(22) PCT Filed: Apr. 14, 2008

(86) PCT No.: PCT/JP2008/000967

§ 371 (c)(1),
(2), (4) Date: Oct. 7, 2008

(87) PCT Pub. No.: WO2008/129876

PCT Pub. Date: Oct. 30, 2008

(65) Prior Publication Data

US 2010/0164997 A1 Jul. 1, 2010

(30) Foreign Application Priority Data

Apr. 18, 2007 (JP) ..... 2007-108889

(51) Int. Cl.
*G09G 3/28* (2006.01)

(52) U.S. Cl. ..... 345/63; 345/60; 345/67; 345/690

(58) Field of Classification Search ..... 345/60–72
See application file for complete search history.

(56) References Cited

U.S. PATENT DOCUMENTS

| | | | | |
|---|---|---|---|---|
| 6,512,501 | B1 * | 1/2003 | Nagaoka et al. | 345/66 |
| 7,764,249 | B2 * | 7/2010 | Kim et al. | 345/60 |
| 7,911,418 | B2 * | 3/2011 | Yoshihama et al. | 345/66 |
| 7,924,242 | B2 * | 4/2011 | Yoon | 345/68 |
| 2004/0113871 | A1 * | 6/2004 | Kashio et al. | 345/63 |
| 2005/0134532 | A1 * | 6/2005 | Choi et al. | 345/60 |
| 2007/0109224 | A1 * | 5/2007 | Choi et al. | 345/67 |
| 2007/0152914 | A1 * | 7/2007 | Park et al. | 345/67 |
| 2009/0207161 | A1 * | 8/2009 | Mima et al. | 345/214 |
| 2010/0001986 | A1 * | 1/2010 | Okada et al. | 345/214 |

FOREIGN PATENT DOCUMENTS

| | | | |
|---|---|---|---|
| JP | 2000-242224 | A | 9/2000 |
| JP | 2005-326612 | A | 11/2005 |
| JP | 2006-308626 | A | 11/2006 |
| WO | WO 2006-112233 | A1 | 10/2006 |

* cited by examiner

*Primary Examiner* — Richard Hjerpe
*Assistant Examiner* — Dorothy Harris
(74) *Attorney, Agent, or Firm* — RatnerPrestia

(57) ABSTRACT

A plasma display device and a driving method thereof are provided. The plasma display device has a panel having a plurality of discharge cells including a display electrode pair that is formed of a scan electrode and a sustain electrode, and a temperature detecting circuit for detecting the ambient temperature of the panel and outputting the detected temperature. In the driving method, an unusual charge erasing period when a rectangular waveform voltage is applied to the scan electrode is disposed between the initializing period and address period of at least one of a plurality of subfields, and the number of subfields having the unusual charge erasing period is controlled based on the detected temperature detected by the temperature detecting circuit.

4 Claims, 9 Drawing Sheets

FIG. 7A

| Subfield | First SF | Second SF | Third SF | Fourth SF | Fifth SF | Sixth SF | Seventh SF | Eighth SF | Ninth SF | 10th SF |
|---|---|---|---|---|---|---|---|---|---|---|
| Initializing operation | All-cell initiali-zing operation | Selectivei initiali-zing operation | Selective initiali-zing operation | Selective initiali-zing operation | Selective initiali-zing operation | Selective initiali-zing operation | Selective initiali-zing operation | Selective initiali-zing operation | Selective initiali-zing operation | Selective initiali-zing operation |
| Unusual charge erasing period | Absence | Presence | Presence | Presence | Presence | Presence | Presence | Presence | Presence | Presence |

FIG. 7B

| Subfield | First SF | Second SF | Third SF | Fourth SF | Fifth SF | Sixth SF | Seventh SF | Eighth SF | Ninth SF | 10th SF |
|---|---|---|---|---|---|---|---|---|---|---|
| Initializing operation | All-cell initiali-zing operation | Selective initiali-zing operation | Selective initiali-zing operation | Selective initiali-zing operation | Selective initiali-zing operation | Selective initiali-zing operation | Selective initiali-zing operation | Selective initiali-zing operation | Selective initiali-zing operation | Selective initiali-zing operation |
| Unusual charge erasing period | Absence | Presence | Absence | Absence | Absence | Absence | Absence | Absence | Absence | Absence |

PLASMA DISPLAY DEVICE AND METHOD FOR DRIVING THE SAME

This application is a U.S. National Phase Application of PCT International application PCT/JP 2008/000967.

TECHNICAL FIELD

The present invention relates to a plasma display device employing a plasma display panel that is used in a wall-hanging television (TV) or a large monitor, and a driving method thereof.

BACKGROUND ART

A typical alternating-current surface discharge type panel used as a plasma display panel (hereinafter referred to as "panel") has many discharge cells between a front plate and a back plate that are faced to each other.

The front plate has the following elements:

- a plurality of display electrode pairs disposed in parallel on a glass-made front substrate; and
- a dielectric layer and a protective layer for covering the display electrode pairs.

Here, each display electrode pair is formed of a pair of scan electrode and sustain electrode. The back plate has the following elements:

- a plurality of data electrodes disposed in parallel on a glass-made back substrate;
- a dielectric layer for covering the data electrodes;
- a plurality of barrier ribs disposed on the dielectric layer in parallel with the data electrodes; and
- phosphor layers disposed on the surface of the dielectric layer and on side surfaces of the barrier ribs.

The front plate and back plate are faced to each other so that the display electrode pairs and the data electrodes three-dimensionally intersect, and are sealed. Discharge gas containing xenon is filled into a discharge space in the sealed product. Discharge cells are disposed in intersecting parts of the display electrode pairs and the data electrodes. In the panel having this structure, ultraviolet rays are emitted by gas discharge in each discharge cell. The ultraviolet rays excite respective phosphor layers of red, green, and blue to emit light, and thus provide color display.

A subfield method is generally used as a method of driving the panel. In this method, one field period is divided into a plurality of subfields, and the subfields at which light is emitted are combined, thereby performing gray scale display.

Each subfield has an initializing period, an address period, and a sustain period. In the initializing period, initializing discharge occurs, and a wall charge required for a subsequent address operation is formed on each electrode. The initializing operation includes an initializing operation (hereinafter referred to as "all-cell initializing operation") of causing initializing discharge in all discharge cells and an initializing operation (hereinafter referred to as "selective initializing operation") of causing initializing discharge in a discharge cell having performed sustain discharge.

In the address period, address discharge is caused in a discharge cell where display is to be performed, thereby forming a wall charge. In the sustain period, a sustain pulse is alternately applied to the display electrode pairs formed of the scan electrodes and the sustain electrodes, sustain discharge is caused in the discharge cell having performed address discharge, and a phosphor layer of the corresponding discharge cell is light-emitted, thereby displaying an image.

Of the subfield method, a new driving method where light emission that is not related to gray scale display is minimized and the contrast ratio is improved is disclosed in patent document 1, for example. In this driving method, the initializing discharge is performed using a gradually varying voltage waveform, and the initializing discharge is selectively applied to the discharge cell having performed sustain discharge.

Specifically, for example, in the initializing period of one of a plurality of subfields, an all-cell initializing operation of causing discharge in all discharge cells is performed. In the initializing period of the other subfields, a selective initializing operation of initializing only a discharge cell having performed sustain discharge is performed. As a result, the light emission that is not related to the display is determined only by light emission following the discharge of the all-cell initializing operation, and an image of high contrast can be displayed.

In this driving method, the number of all-cell initializing operations is restricted. Therefore, the initializing operation becomes unstable, and a malfunction (hereinafter referred to as "false lighting") can occur that causes sustain discharge in the discharge cell where address discharge has not been caused. Therefore, a driving method for stabilizing the initializing discharge by providing an unusual charge erasing part in the all-cell initializing period is disclosed in patent document 2, for example.

The screen size and definition of the panel have been recently increased, and study has been performed to improve the light emitting efficiency of the panel by increasing the partial pressure of xenon in the discharge gas filled into the panel. However, fining the discharge cell and increasing the efficiency of it elongate the discharge delay, and further the discharge is apt to become unstable. When the initializing operation becomes unstable, the false lighting is further apt to occur, and the image display quality can be significantly reduced. Such phenomenon is apt to occur when the panel temperature is low.

[Patent document 1] Japanese Patent Unexamined Publication No. 2000-242224

[Patent document 2] Japanese Patent Unexamined Publication No. 2005-326612

SUMMARY OF THE INVENTION

The present invention provides a plasma display device that does not cause false lighting in a large temperature range and does not significantly reduce the image display quality, and a driving method thereof.

This driving method of the plasma display device is used for the following plasma display device. The plasma display device has the following elements:

- a plasma display panel having a plurality of discharge cells including a display electrode pair that is formed of a scan electrode and a sustain electrode; and
- a temperature detecting circuit for detecting the ambient temperature of the plasma display panel and outputting the detected temperature.

The plasma display device displays an image by forming one field period by arranging a plurality of subfields. Each of the subfields has the following periods:

- an initializing period for causing initializing discharge in a discharge cell;
- an address period for causing address discharge in the discharge cell; and
- a sustain period for causing sustain discharge in the discharge cell.

In the driving method, an unusual charge erasing period when a rectangular waveform voltage is applied to the scan electrode is disposed between the initializing period and address period of at least one of the plurality of subfields, and the number of subfields having the unusual charge erasing period is controlled based on the detected temperature detected by the temperature detecting circuit.

The plasma display device has the following elements:

- a plasma display panel having a plurality of discharge cells including a display electrode pair that is formed of a scan electrode and a sustain electrode;
- a temperature detecting circuit for detecting the ambient temperature of the plasma display panel and outputting the detected temperature; and
- a panel driving circuit for displaying an image by forming one field period by arranging a plurality of subfields, each of which has the following periods:
  - an initializing period for causing initializing discharge in a discharge cell;
  - an address period for causing address discharge in the discharge cell; and
  - a sustain period for causing sustain discharge in the discharge cell.

The panel driving circuit has an unusual charge erasing period when a rectangular waveform voltage is applied to the scan electrode, between the initializing period and address period of at least one of the plurality of subfields. The panel driving circuit controls the number of subfields having the unusual charge erasing period based on the detected temperature detected by the temperature detecting circuit.

BRIEF DESCRIPTION OF DRAWINGS

FIG. 7A is a diagram showing a subfield structure in accordance with the exemplary embodiment.

FIG. 7B is a diagram showing another subfield structure in accordance with the exemplary embodiment.

REFERENCE MARKS IN THE DRAWINGS

Figure 1:
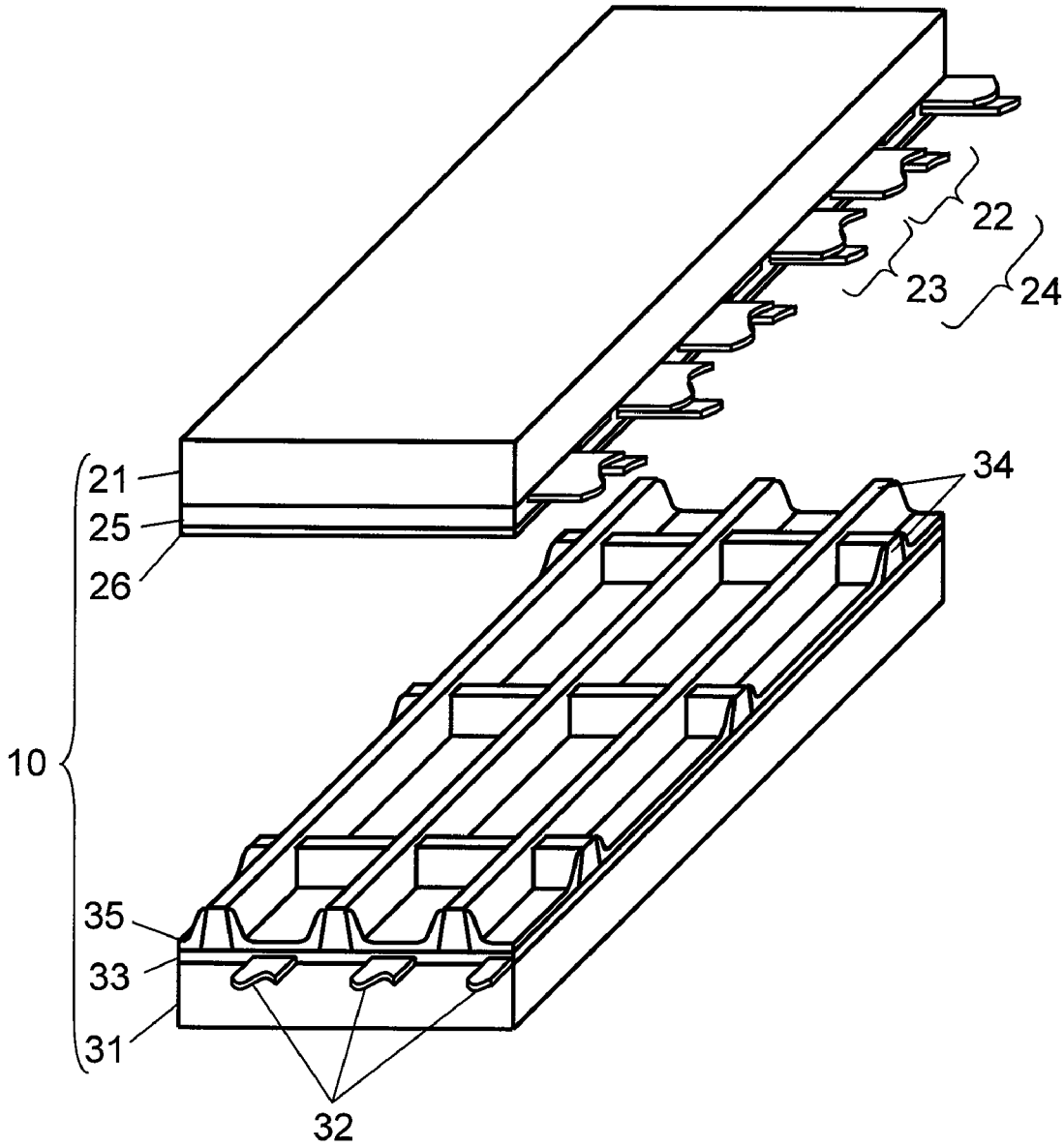
FIG. 1 is an exploded perspective view showing a structure of a panel in accordance with an exemplary embodiment of the present invention.

| | |
|---|---|
| 10 | panel |
| 22 | scan electrode |

-continued

REFERENCE MARKS IN THE DRAWINGS

| | |
|---|---|
| 23 | sustain electrode |
| 24 | display electrode pair |
| 32 | data electrode |
| 40 | panel driving circuit |
| 41 | image signal processing circuit |
| 42 | data electrode driving circuit |
| 43 | scan electrode driving circuit |
| 44 | sustain electrode driving circuit |
| 45 | timing generating circuit |
| 46 | temperature detecting circuit |
| 51 | sustain pulse generating part |
| 53 | rising gradient voltage generating part |
| 55 | falling gradient voltage generating part |
| 57 | scan pulse voltage applying part |
| 81 | odd scan pulse generating part |
| 86 | even scan pulse generating part |
| 90 | composite switch part |
| 100 | plasma display device |

DETAILED DESCRIPTION OF PREFERRED EMBODIMENTS

A plasma display device and method for driving the same in accordance with an exemplary embodiment of the present invention will be described hereinafter with reference to the accompanying drawings.

Exemplary Embodiment

FIG. 1 is an exploded perspective view showing a structure of panel 10 in accordance with the exemplary embodiment of the present invention. A plurality of display electrode pairs 24 formed of scan electrodes 22 and sustain electrodes 23 are disposed on glass-made front substrate 21. Dielectric layer 25 is formed so as to cover scan electrodes 22 and sustain electrodes 23, and protective layer 26 is formed on dielectric layer 25. A plurality of data electrodes 32 are formed on back substrate 31, dielectric layer 33 is formed so as to cover data electrodes 32, and mesh barrier ribs 34 are formed on dielectric layer 33. Phosphor layers 35 for emitting lights of respective colors of red, green, and blue are formed on the side surfaces of barrier ribs 34 and on dielectric layer 33.

Front substrate 21 and back substrate 31 are faced to each other so that display electrode pairs 24 cross data electrodes 32 with a micro discharge space sandwiched between them, and the outer peripheries of them are sealed by a sealing material such as glass frit. The discharge space is filled with mixed gas of neon and xenon, for example, as discharge gas. In the present embodiment, discharge gas where xenon partial pressure is set at 10% for luminance improvement is employed. The discharge space is partitioned into a plurality of sections by barrier ribs 34. Discharge cells are formed in the intersecting parts of display electrode pairs 24 and data electrodes 32. The discharge cells discharge and emit light to display an image.

The structure of the panel is not limited to the above-mentioned one, but may be a structure having striped barrier ribs, for example.

Figure 2:
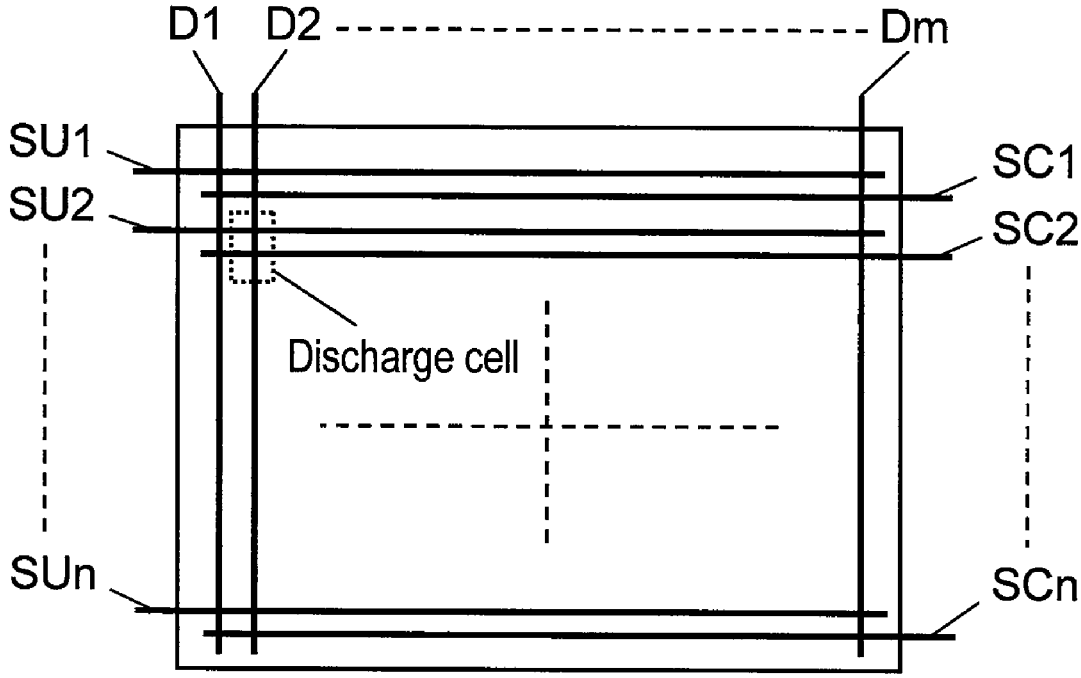
FIG. 2 is an electrode array diagram of the panel in accordance with the exemplary embodiment.

FIG. 2 is an electrode array diagram of panel 10 in accordance with the exemplary embodiment of the present invention. In panel 10, n scan electrodes SC1 through SCn (scan electrodes 22 in FIG. 1) and n sustain electrodes SU1 through SUn (sustain electrodes 23 in FIG. 1) long in the column direction are arranged, and m data electrodes D1 through Dm (data electrodes 32 in FIG. 1) long in the row direction are arranged. Each discharge cell is formed in the intersecting part of a pair of scan electrode SCi (i is 1 through n) and sustain electrode SUi and one data electrode Dj (j is 1 through m), the number of formed discharge cells in the discharge space is m×n. In the description of the present embodiment, "n" is assumed to be even. However, "n" may be odd.

Figure 3:
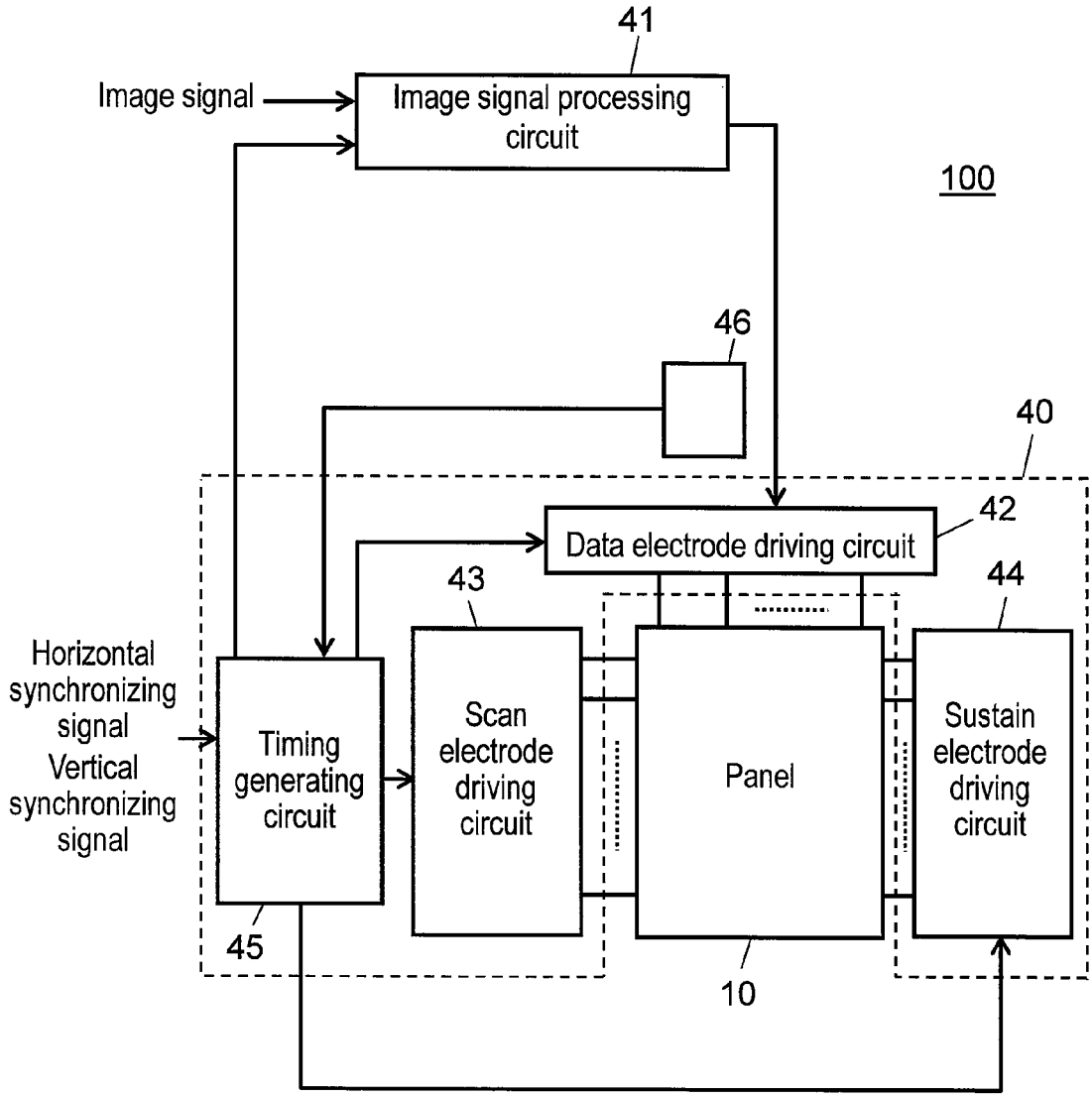
FIG. 3 is a circuit block diagram of a plasma display device in accordance with the exemplary embodiment.

FIG. 3 is a circuit block diagram of plasma display device 100 in accordance with the exemplary embodiment of the present invention. Plasma display device 100 has the following elements:

panel 10;
panel driving circuit 40;
image signal processing circuit 41;
temperature detecting circuit 46; and
a power supply circuit (not shown) for supplying power required for each circuit block.

Panel driving circuit 40 has data electrode driving circuit 42, scan electrode driving circuit 43, sustain electrode driving circuit 44, and timing generating circuit 45.

Temperature detecting circuit 46 has a generally known heat-sensitive element, such as a thermistor and a thermocouple, for detecting temperature, and detects the ambient temperature of panel 10.

Image signal processing circuit 41 converts an input image signal into image data that indicates emission or non-emission of light in each subfield. Data electrode driving circuit 42 converts the image data of each subfield into a signal corresponding to each of data electrodes D1 through Dm, and drives each of data electrodes D1 through Dm.

Timing generating circuit 45 generates various timing signals for controlling the operation of each circuit based on a horizontal synchronizing signal, a vertical synchronizing signal, and the detected temperature output from temperature detecting circuit 46, and supplies them to respective circuits. Scan electrode driving circuit 43 drives each of scan electrodes SC1 through SCn based on the timing signal. Sustain electrode driving circuit 44 drives sustain electrodes SU1 through SUn based on the timing signal.

Next, a driving voltage waveform for driving panel 10 and its operation are described. Plasma display device 100 performs gray scale display by a subfield method. In this method, one field period is divided into a plurality of subfields, and emission and non-emission of light of each discharge cell are controlled in each subfield. Each subfield has an initializing period, an address period, and a sustain period. In the present embodiment, an unusual charge erasing period is disposed between the initializing period and address period as necessary.

In the initializing period, initializing discharge is performed to form, on each electrode, a wall charge required for a subsequent address discharge. The initializing operation at this time includes an all-cell initializing operation and a selective initializing operation.

In the unusual charge erasing period, positive rectangular waveform voltage and negative rectangular waveform voltage are applied to scan electrodes SC1 through SCn. If the initializing operation in the preceding all-cell initializing operation becomes unstable and unusual charge is accumulated in a discharge cell, the unusual charge in the discharge cell is erased in the unusual charge erasing period.

In the address period, address discharge is caused in a discharge cell to emit light, thereby forming a wall charge. In the sustain period, as many sustain pulses as the number corresponding to luminance weight are alternately applied to display electrode pairs 24, and sustain discharge is caused in the discharge cell having caused address discharge, thereby emitting light.

Details on the subfield structure are described later. A driving voltage waveform in a subfield and its operation are described here.

Figure 4:
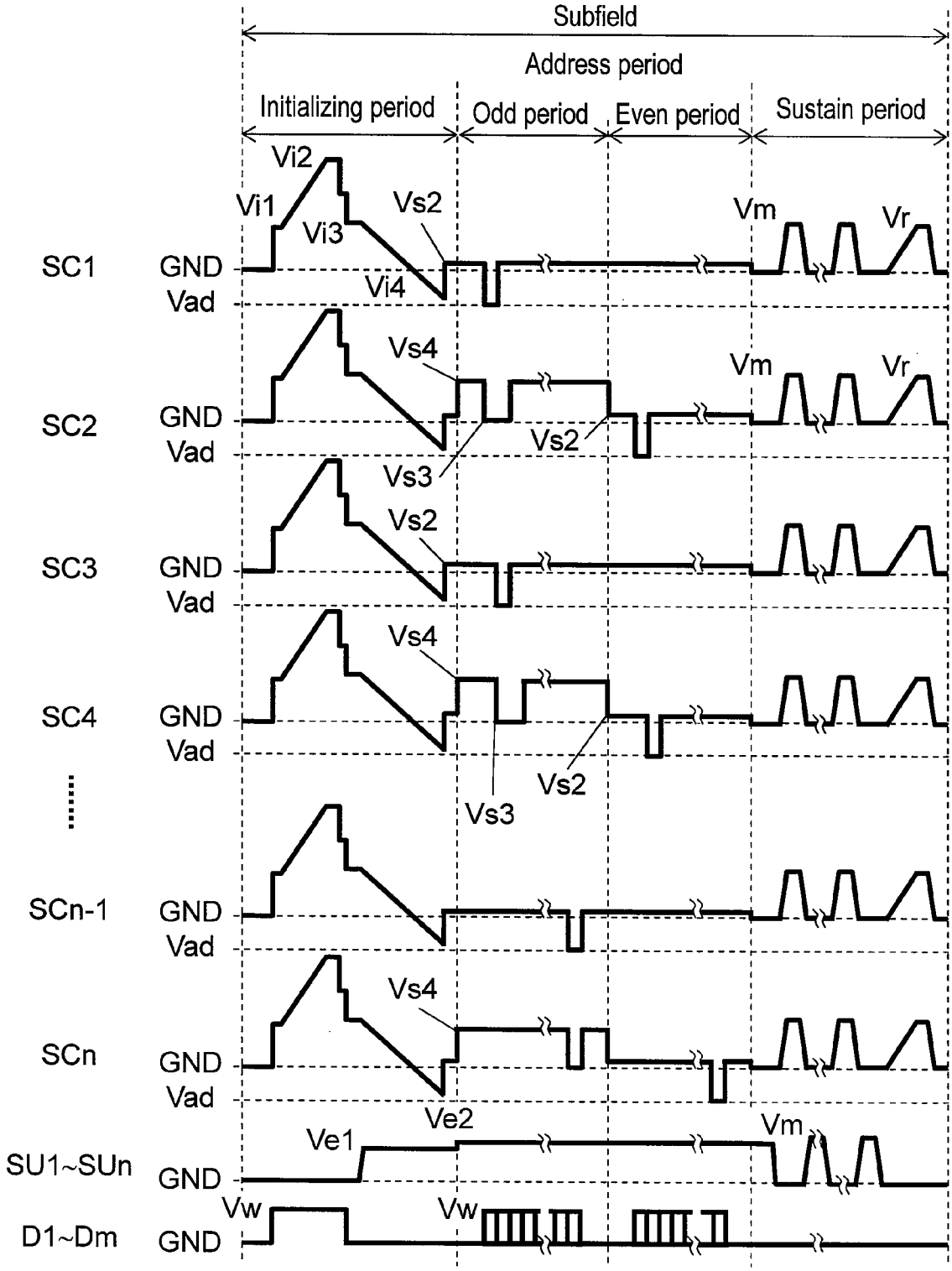
FIG. 4 is a waveform chart of driving voltage applied to each electrode of the panel in an all-cell initializing operation in accordance with the exemplary embodiment.
Figure 5:
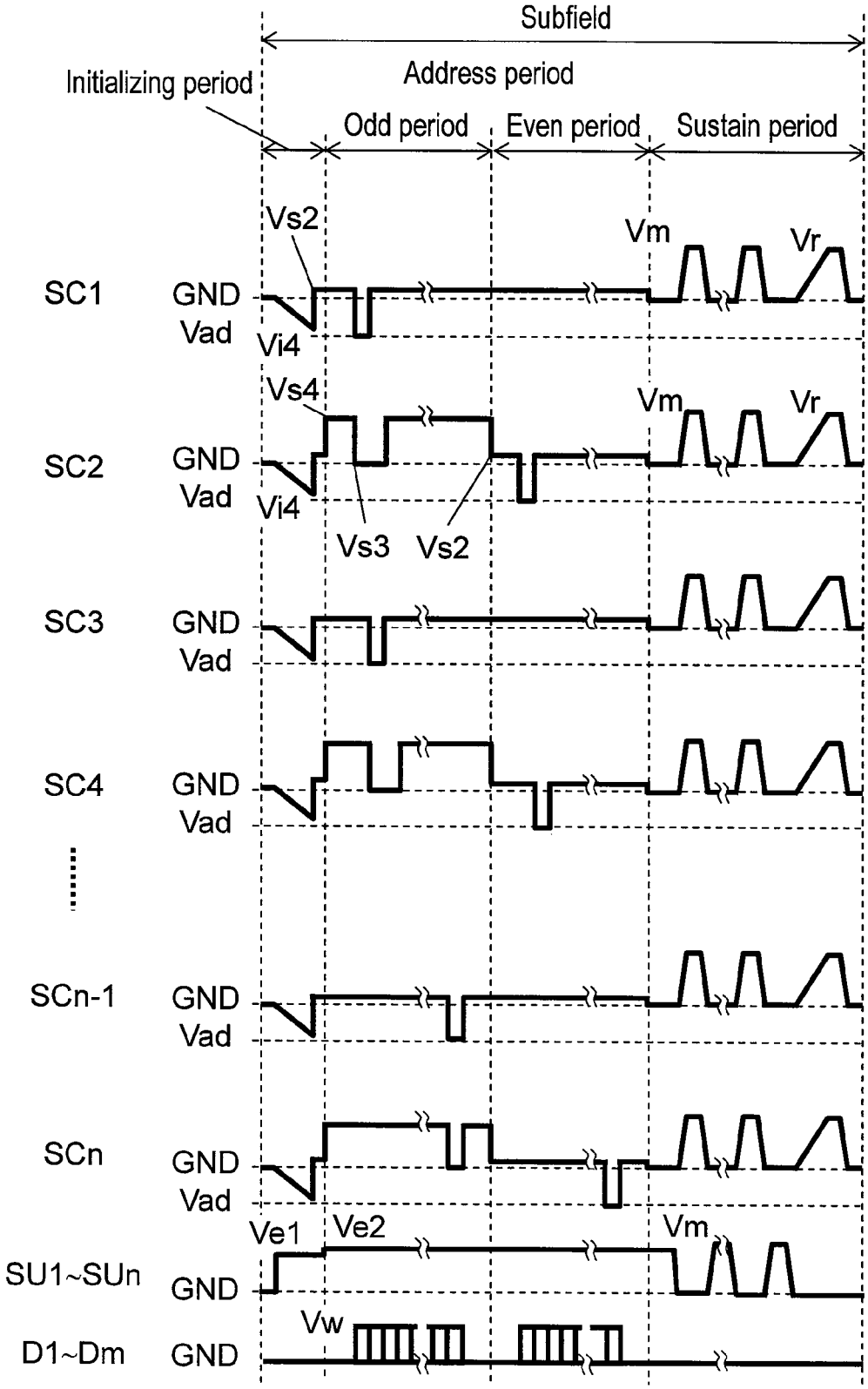
FIG. 5 is a waveform chart of driving voltage in a subfield that is a selective initializing subfield and has no unusual charge erasing period in accordance with the exemplary embodiment.
Figure 6:
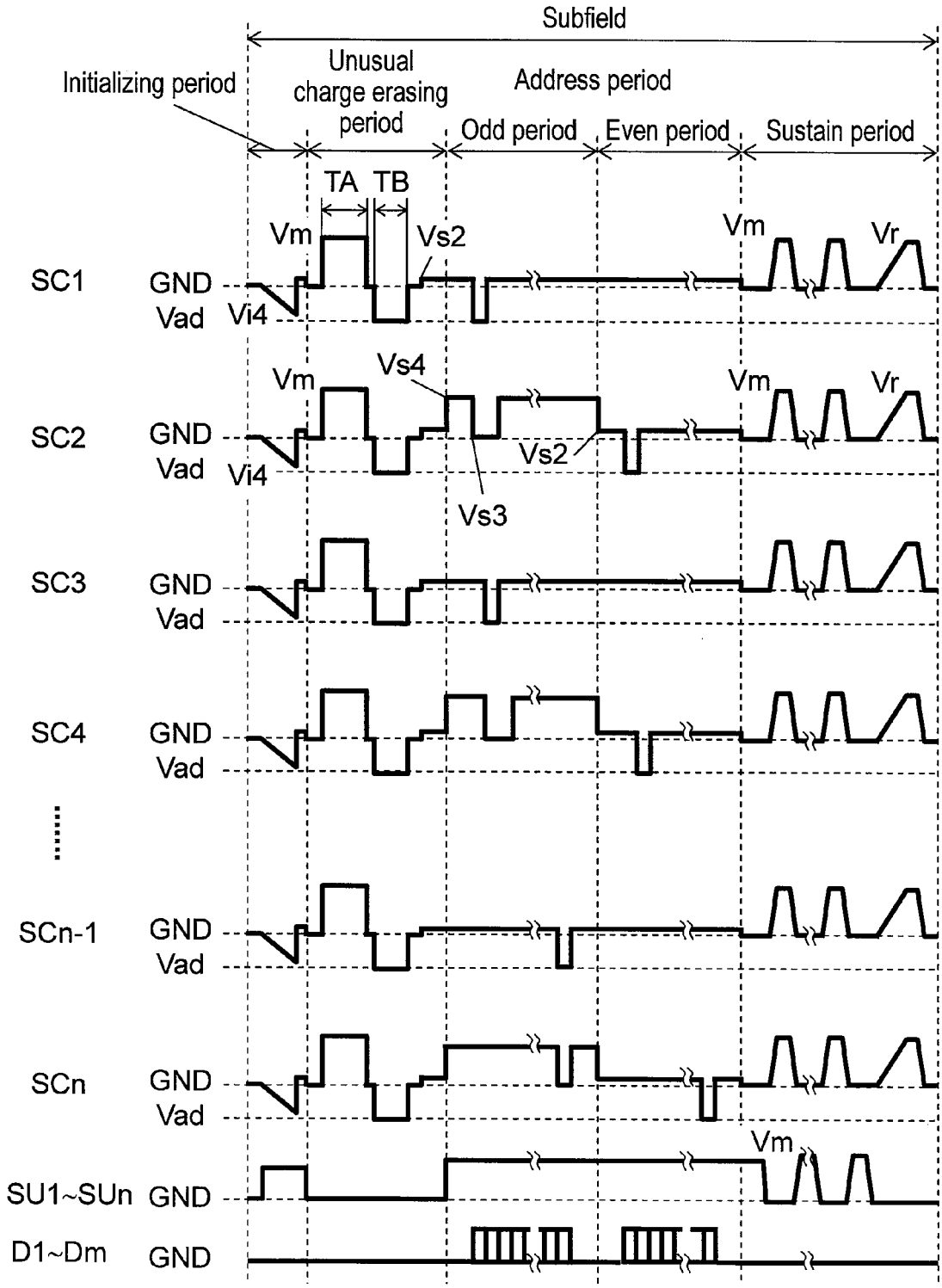
FIG. 6 is a waveform chart of driving voltage in a subfield that is a selective initializing subfield and has an unusual charge erasing period in accordance with the exemplary embodiment.
Figure 8:
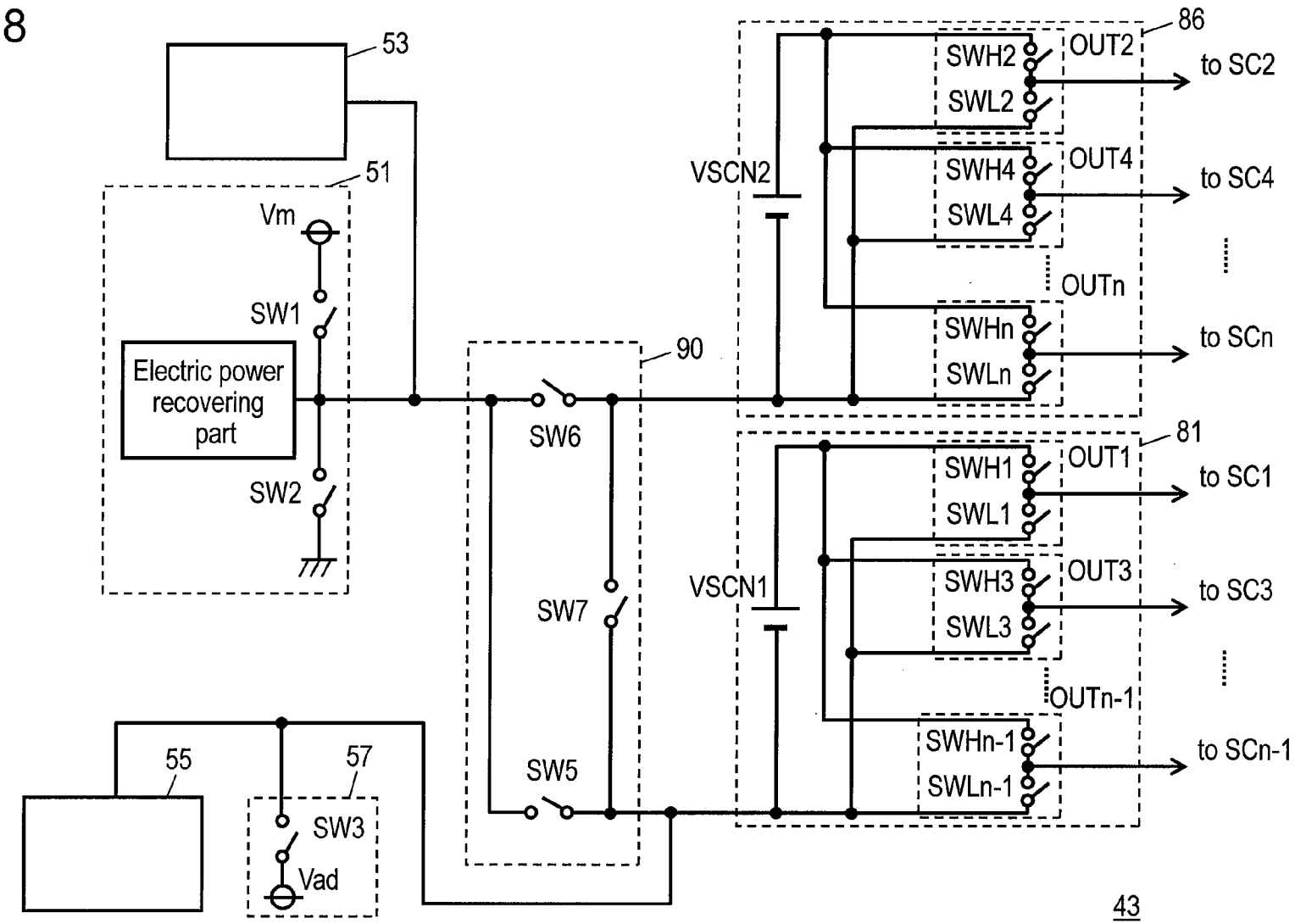
FIG. 8 is a circuit diagram of a scan electrode driving circuit in accordance with the exemplary embodiment.

FIG. 4, FIG. 5, and FIG. 6 are waveform charts of driving voltage applied to each electrode of panel 10 in accordance with the exemplary embodiment of the present invention. FIG. 4 shows a subfield (hereinafter referred to as "all-cell initializing subfield") that performs the all-cell initializing operation and has no unusual charge erasing period. FIG. 5 shows a subfield (hereinafter referred to as "selective initializing subfield") that performs the selective initializing operation and has no unusual charge erasing period. FIG. 6 shows a subfield that is a selective initializing subfield and has an unusual charge erasing period.

First, the all-cell initializing subfield having no unusual charge erasing period is described using FIG. 4.

In the first half of the initializing period, address pulse voltage Vw is applied to data electrodes D1 through Dm, and voltage 0 (V) is applied to sustain electrodes SU1 through SUn. A gradient waveform voltage is applied to scan electrodes SC1 through SCn. Here, the gradient waveform voltage gradually increases from voltage Vi1, which is not higher than a discharge start voltage, to voltage Vi2, which is higher than the discharge start voltage, with respect to sustain electrodes SU1 through SUn.

While the waveform voltage increases, feeble initializing discharge occurs between scan electrodes SC1 through SCn and sustain electrodes SU1 through SUn, and feeble initializing discharge occurs between scan electrodes SC1 through SCn and data electrodes D1 through Dm. Negative wall voltage is accumulated on scan electrodes SC1 through SCn, and positive wall voltage is accumulated on data electrodes D1 through Dm and sustain electrodes SU1 through SUn. Here, the wall voltage on the electrodes means the voltage generated by the wall charges accumulated on the dielectric layer covering the electrodes, the protective layer, and the phosphor layer.

In the last half of the initializing period, 0 (V) is applied to data electrodes D1 through Dm. Then, positive voltage Ve1 is applied to sustain electrodes SU1 through SUn, and a gradient waveform voltage is applied to scan electrodes SC1 through SCn. Here, the gradient waveform voltage gradually decreases from voltage Vi3, which is not higher than the discharge start voltage, to voltage Vi4, which is higher than the discharge start voltage, with respect to sustain electrodes SU1 through SUn. While the gradient waveform voltage decreases, feeble initializing discharge occurs between scan electrodes SC1 through SCn and sustain electrodes SU1 through SUn, and feeble initializing discharge occurs between scan electrodes SC1 through SCn and data electrodes D1 through Dm. Then, the negative wall voltage on scan electrodes SC1 through SCn and the positive wall voltage on sustain electrodes SU1 through SUn are reduced, positive wall voltage on data electrodes D1 through Dm is adjusted to a value suitable for the address operation. Thus, the all-cell initializing operation of applying initializing discharge to all discharge cells is completed.

The above description shows a case where the all-cell initializing operation is performed normally. When the discharge becomes unstable due to the elongation of the discharge delay or the like, though the gradually varying gradient waveform voltage is applied, strong discharge can occur between scan electrodes SC1 through SCn and data electrodes D1 through Dm, and strong discharge can occur between scan electrodes SC1 through SCn and sustain electrodes SU1 through SUn. Such strong discharge is referred to as "unusual initializing discharge." When the unusual initializing discharge occurs in the last half of the all-cell initializing period, positive wall voltage is accumulated on scan electrodes SC1 through SCn, negative wall voltage is accumulated on sustain electrodes SU1 through SUn, and some wall voltage is accumulated on data electrodes D1 through Dm. When the unusual initializing discharge occurs in the first half of the all-cell initializing period, unusual initializing discharge occurs again in the last half of the all-cell initializing period, and hence the above-mentioned wall voltages are accumulated. These wall voltages disturb a normal operation of the discharge cell, so that the wall charge generating the wall voltages is referred to as "unusual discharge".

In an odd period of the subsequent address period, voltage Ve2 is applied to sustain electrodes SU1 through SUn, second voltage Vs2 is applied to each of odd-numbered scan electrode SC1, scan electrode SC3, . . . , and scan electrode SCn−1, and fourth voltage Vs4 is applied to each of even-numbered scan electrode SC2, scan electrode SC4, . . . , and scan electrode SCn. Here, fourth voltage Vs4 is higher than second voltage Vs2.

Next, scan pulse voltage Vad is applied in order to apply a negative scan pulse to first scan electrode SC1. Positive address pulse voltage Vw is applied to data electrode Dk (k is 1 through m), of data electrodes D1 through Dm, in the discharge cell to emit light in the first column. At this time in the present embodiment, third voltage Vs3 lower than fourth voltage Vs4 is applied to a scan electrode adjacent to scan electrode SC1, namely second scan electrode SC2. This prevents excessive voltage difference from being applied between adjacent scan electrode SC1 and second scan electrode SC2.

The voltage difference in the intersecting part of data electrode Dk of the discharge cell to which positive address pulse voltage Vw is applied and scan electrode SC1 is derived by adding the difference between the wall voltage on data electrode Dk and that on scan electrode SC1 to the difference (Vw−Vad) of the external applied voltage, and exceeds the discharge start voltage. Address discharge occurs between data electrode Dk and scan electrode SC1 and between sustain electrode SU1 and scan electrode SC1. Positive wall voltage is accumulated on scan electrode SC1, negative wall voltage is accumulated on sustain electrode SU1, and negative wall voltage is also accumulated on data electrode Dk. Thus, an address operation is performed that causes address discharge in the discharge cell to emit light in the first column and accumulates wall voltage on each electrode. The voltage in the intersecting parts of scan electrode SC1 and data electrodes D1 through Dm to which address pulse voltage Vw is not applied does not exceed the discharge start voltage, so that address discharge does not occur.

Regarding odd-numbered scan electrode SC3, scan electrode SC5, . . . , and scan electrode SCn−1, an address operation is performed similarly. Third voltage Vs3 is also applied to even-numbered scan electrode SCp (p is even number, $1<p<n$) and scan electrode SCp+2 adjacent to the odd-numbered scan electrode SCp+1 where the address operation is performed at this time.

In a subsequent even period, second voltage Vs2 is applied to even-numbered scan electrode SC2, scan electrode SC4, . . . , scan electrode SCn while second voltage Vs2 is applied to odd-numbered scan electrode SC1, scan electrode SC3, . . . , scan electrode SCn−1.

Next, scan pulse voltage Vad is applied in order to apply a negative scan pulse to second scan electrode SC2. Positive address pulse voltage Vw is applied to data electrode Dk, of data electrodes D1 through Dm, in the discharge cell to emit light in the second column. The voltage difference in the intersecting part of data electrode Dk of the discharge cell and scan electrode SC2 exceeds the discharge start voltage, and causes address discharge in the discharge cell to emit light in the second column, thereby performing an address operation of accumulating wall voltage on each electrode.

Regarding even-numbered scan electrode SC4, scan electrode SC6, . . . , and scan electrode SCn, an address operation is performed similarly.

The discharge cell having an unusual charge has no wall voltage required for address discharge, so that normal address discharge does not occur.

In the subsequent sustain period, positive sustain pulse voltage Vm is firstly applied to scan electrodes SC1 through SCn, and voltage 0 (V) is applied to sustain electrodes SU1 through SUn. In the discharge cell having caused the address discharge, the voltage difference between scan electrode SCi and sustain electrode SUi is obtained by adding the difference between the wall voltage on scan electrode SCi and that on sustain electrode SUi to sustain pulse voltage Vm, and exceeds the discharge start voltage. Sustain discharge occurs between scan electrode SCi and sustain electrode SUi, and ultraviolet rays generated at this time cause phosphor layer 35 to emit light. Negative wall voltage is accumulated on scan electrode SCi, and positive wall voltage is accumulated on sustain electrode SUi. Positive wall voltage is also accumulated on data electrode Dk. In the discharge cell where address discharge does not occur in the address period, sustain discharge does not occur, and the wall voltage at the completion of the initializing period is kept.

Subsequently, voltage 0 (V) is applied to scan electrodes SC1 through SCn, and sustain pulse voltage Vm is applied to sustain electrodes SU1 through SUn. In the discharge cell having caused the sustain discharge, the voltage difference between sustain electrode SUi and scan electrode SCi exceeds the discharge start voltage. Therefore, sustain discharge occurs between sustain electrode SUi and scan electrode SCi again. Negative wall voltage is accumulated on sustain electrode SUi, and positive wall voltage is accumulated on scan electrode SCi. Hereinafter, similarly, as many sustain pulses as the number corresponding to the luminance weight are alternately applied to scan electrodes SC1 through SCn and sustain electrodes SU1 through SUn, and potential difference is caused between the electrodes of display electrode pairs 24. Thus, sustain discharge occurs continuously in the discharge cell that has caused the address discharge in the address period.

At the end of the sustain period, gradient waveform voltage that is equal to sustain pulse voltage Vm or gradually increases to voltage Vr higher than Vm is applied to scan electrodes SC1 through SCn. While the positive wall voltage is kept on data electrode Dk, wall voltages on scan electrode SCi and sustain electrode SUi are reduced. Thus, the sustain operation in the sustain period is completed.

In the discharge cell having unusual charge, the positive wall voltage is accumulated on scan electrode SCi and the negative wall voltage is accumulated on sustain electrode SUi, so that sustain discharge can occur. However, the unusual charge is not large enough to certainly cause the sustain discharge, so that the sustain discharge accidentally occurs. When sustain discharge does not occur in the first subfield, sustain discharge can occur in the sustain period of the next subfield. Thus, in the discharge cell having unusual charge, discharge can always occur when sustain pulse voltage Vm is applied to one of display electrode pair 24. Once sustain discharge occurs in the sustain period, the initializing operation is normally performed in the initializing period following the sustain period, and hence a normal operation is performed in the subsequent subfield.

Next, an operation of the selective initializing subfield having no unusual charge erasing period is described using FIG. 5.

In the initializing period when the selective initializing operation is performed, voltage Ve1 is applied to sustain electrodes SU1 through SUn, voltage 0 (V) is applied to data electrodes D1 through Dm, and a gradient waveform voltage gradually decreasing from voltage 0 (V) to voltage Vi4 is applied to scan electrodes SC1 through SCn.

Thus, in the discharge cell that has caused the sustain discharge in the sustain period of the previous subfield, feeble initializing discharge occurs, and the wall voltage on scan electrode SCi and sustain electrode SUi is reduced. Sufficient positive wall voltage is accumulated on data electrode Dk by the next previous sustain discharge, so that the wall voltage is discharged by the excessive amount to be adjusted to a wall voltage appropriate for the address operation.

While, in the discharge cell that has not caused the sustain discharge in the previous subfield, discharge is not performed and the wall charge at the completion of the initializing period of the previous subfield is kept. Such selective initializing operation is an operation of selectively performing the initializing discharge in the discharge cell where a sustain operation is performed in the sustain period of the next previous subfield.

The operation in the subsequent address period is similar to that in the address period of the all-cell initializing subfield, so that the description of it is omitted. The operation in the subsequent sustain period is similar except for the number of sustain pulses.

Next, an operation of the selective initializing subfield having an unusual charge erasing period is described using FIG. 6. The selective initializing operation in the initializing period, the address operation in the address period, and the sustain operation in the sustain period are similar to respective operations in the selective initializing subfield having no unusual charge erasing period, so that the descriptions of them are omitted.

In the unusual charge erasing period, while data electrodes D1 through Dm are kept at voltage 0 (V), positive rectangular waveform voltage, namely rectangular waveform voltage Vm in the present embodiment, is applied to scan electrodes SC1 through SCn, and voltage 0 (V) is applied to sustain electrodes SU1 through SUn. The voltage applied to each electrode is the same when first sustain pulse voltage Vm is applied to scan electrodes SC1 through SCn in the sustain period. As discussed above, the sustain discharge does not occur in the discharge cell that has not undergone the address discharge. However, the unusual charge erasing period is disposed just after the initializing period and before the address period, so that discharge does not occur in the unusual charge erasing period in a normal discharge cell.

In the discharge cell having the unusual charge, however, positive rectangular waveform voltage Vm is applied to scan electrodes SC1 through SCn and hence the discharge can occur. In the present embodiment, the period when positive rectangular waveform voltage Vm is applied to scan electrodes SC1 through SCn is set longer than the duration of the sustain pulse in the sustain period. The probability of discharge in the discharge cell having the unusual charge in the unusual charge erasing period is higher than the probability of discharge by the sustain pulse, and discharge can be performed in many of the discharge cells having unusual charge in the unusual charge erasing period.

Next, while data electrodes D1 through Dm and sustain electrodes SU1 through SUn are kept at voltage 0 (V), negative rectangular waveform voltage, namely rectangular waveform voltage Vad in the present embodiment, is applied to scan electrodes SC1 through SCn. Then, discharge occurs again in the discharge cell having the unusual charge, and the unusual charge is removed. Therefore, sustain discharge no longer occurs in the sustain period. However, wall charge required for the address operation is also erased when the unusual charge is removed, and hence address operation cannot be performed. Such a wall charge state continues until the next all-cell initializing subfield is performed. In FIG. 6, the period when positive rectangular waveform voltage Vm is applied to scan electrodes SC1 through SCn is denoted with period TA, and the period when negative rectangular waveform voltage Vad is applied is denoted with period TB.

Next, the subfield structure of the present embodiment is described. In the present embodiment, one field is divided into 10 subfields (first SF, second SF, . . . , 10th SF), and respective subfields are assumed to have luminance weights of 1, 2, 3, 6, 11, 18, 30, 44, 60 and 80, for example. The number of subfields and luminance weight of each subfield are not limited to the above-mentioned values.

In the present embodiment, the subfield structure is changed for driving based on the detected temperature. FIG. 7A and FIG. 7B are diagrams showing subfield structures in accordance with the exemplary embodiment of the present invention. FIG. 7A shows the case where the detected temperature is lower than a predetermined temperature threshold, and FIG. 7B shows the case where the detected temperature is the predetermined temperature threshold or higher. In the embodiment of the present invention, the first SF is an all-cell initializing subfield, and the second SF through 10th SF are selective initializing subfields. As shown in FIG. 7B, when the detected temperature by temperature detecting circuit 46 is the predetermined temperature threshold or higher, an unusual charge erasing period is disposed in the second SF, and no unusual charge erasing period is disposed in the other subfields. As shown in FIG. 7A, when the detected temperature by temperature detecting circuit 46 is lower than the predetermined temperature threshold, an unusual charge erasing period is disposed in the second SF through 10th SF.

As discussed above, the discharge cell having unusual charge can accidentally cause sustain discharge in the sustain period of each subfield. Once the sustain discharge occurs, the sustain discharge continues to the completion of the sustain period. The light emitted by the sustain discharge can be brighter in the subfield of larger luminance weight, namely in the subfield disposed backward in the present embodiment. When the discharge cell that must not emit light emits bright light, the image discharge quality is significantly damaged. Therefore, the light emission luminance by the unusual charge must be minimized. In order to minimize it, preferably, an unusual charge erasing period is disposed early after the all-cell initializing operation, and the unusual charge is erased. In the present embodiment, the unusual charge erasing period is disposed in the second SF for this purpose.

When the temperature of panel 10 is low, however, the discharge delay time becomes long, discharge does not occur in the unusual charge erasing period of the second SF, and the unusual charge is not always removed. In the present embodiment, when the detected temperature is lower than the temperature threshold, an unusual charge erasing period is also disposed in the subsequent third SF, fourth SF, etc. Therefore, even when the temperature of panel 10 is low and the discharge delay time becomes long, the unusual charge is removed in the unusual charge erasing period disposed in one of the second SF through 10th SF, and hence false lighting can be prevented.

In the present embodiment, the predetermined temperature threshold is 17° C., for example. However, it is preferable that this value is set appropriately in response to the discharge characteristic or the like of the panel. A plurality of temperature thresholds may be set, and control may be performed so that the number of subfields having the unusual charge erasing period is decreased with increase in temperature.

In the present embodiment, the period when positive rectangular waveform voltage Vm is applied to scan electrodes SC1 through SCn, namely period TA, is set at 3 μsec. The period when negative rectangular waveform voltage Vad is applied to scan electrodes SC1 through SCn, namely period TB, is also set at 3 μsec. However, period TA and period TB are set appropriately in response to the discharge characteristic or the like of the panel. Control may be performed so that the period TA and period TB are decreased with decrease in temperature.

Figure 9:
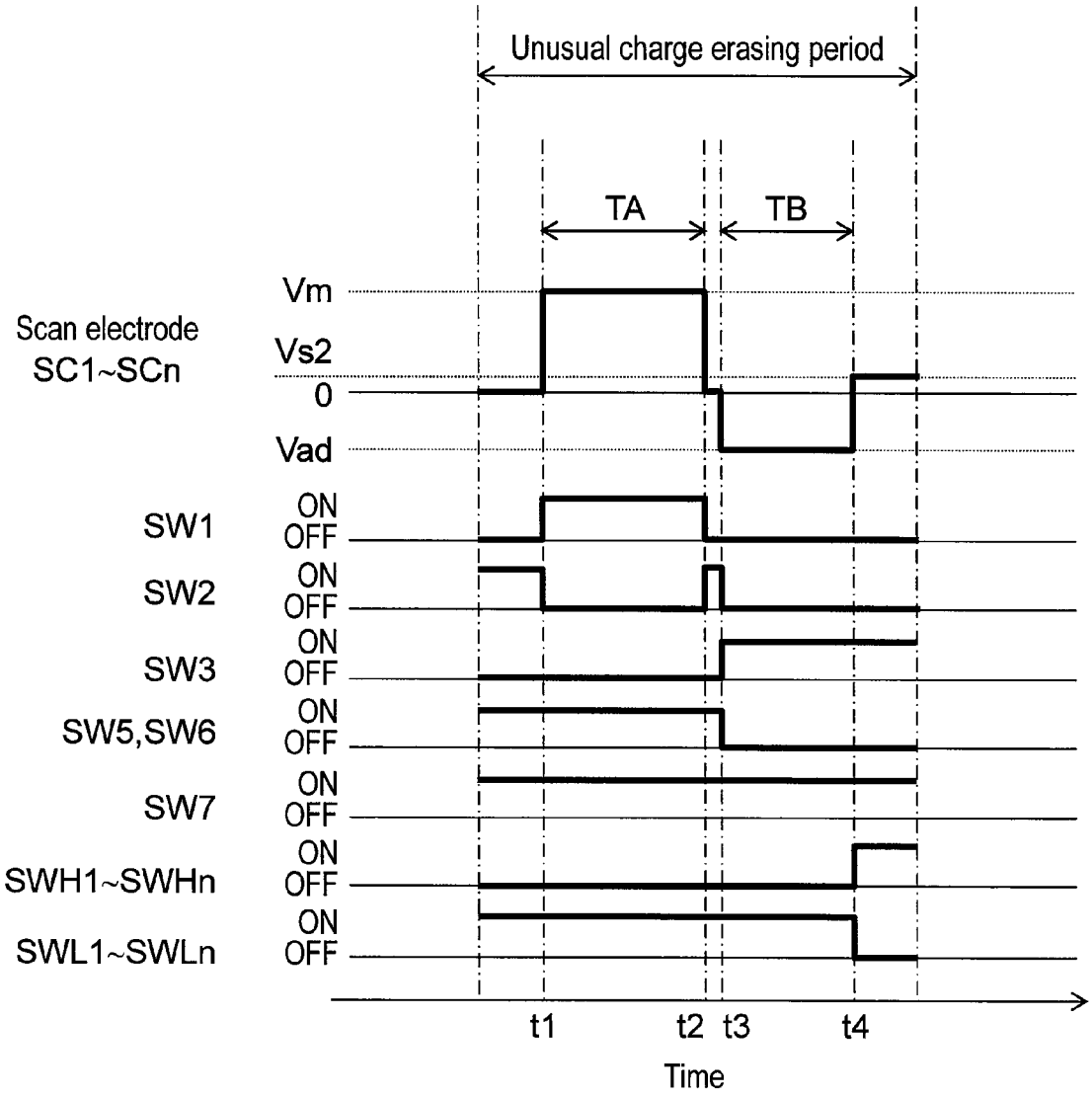
FIG. 9 is a timing chart for illustrating an operation of the scan electrode driving circuit in the unusual charge erasing period in accordance with the exemplary embodiment.

Next, a method of generating the driving voltage waveform in the unusual charge erasing period is described. FIG. 9 is a circuit diagram of scan electrode driving circuit 43 in accordance with the exemplary embodiment of the present invention. Scan electrode driving circuit 43 has sustain pulse generating part 51, rising gradient voltage generating part 53, falling gradient voltage generating part 55, scan pulse voltage applying part 57, odd scan pulse generating part 81, even scan pulse generating part 86, and composite switch part 90.

Sustain pulse generating part 51 has switching element SW1 for outputting sustain pulse voltage Vm, switching element SW2 for outputting voltage 0 (V), and an electric power recovering part for recovering electric power. Sustain pulse generating part 51 generates a sustain pulse to be applied to scan electrodes SC1 through SCn in the sustain period. Rising gradient voltage generating part 53 generates a gradually increasing gradient waveform voltage to be applied to scan electrodes SC1 through SCn in the first half of the initializing period.

Odd scan pulse generating part 81 has floating power supply VSCN1 of voltage Vscn, and output parts OUT1, OUT3, . . . , and OUTn−1. Output parts OUT1, OUT3, . . . , and OUTn−1 apply reference voltage on the low voltage side of floating power supply VSCN1 or voltage on the high voltage side to each of odd-numbered scan electrode SC1, scan electrode SC3, . . . , and scan electrode SCn−1. Output parts OUT1, OUT3, . . . , and OUTn−1 have switching elements SWH1, SWH3, . . . , and SWHn−1 for outputting voltage on the high voltage side of floating power supply VSCN1, and switching elements SWL1, SWL3, . . . , and SWLn−1 for outputting reference voltage on the low voltage side of floating power supply VSCN1.

Even scan pulse generating part 86 similarly has floating power supply VSCN2 of voltage Vscn, and output parts OUT2, OUT4, . . . , and OUTn. Output parts OUT2, OUT4, . . . , and OUTn apply reference voltage on the low voltage side of floating power supply VSCN2 or voltage on the high voltage side to each of even-numbered scan electrode SC2, scan electrode SC4, . . . , and scan electrode SCn. Output parts OUT2, OUT4, . . . , and OUTn have switching elements SWH2, SWH4, . . . , and SWHn for outputting voltage on the high voltage side of floating power supply VSCN2, and switching elements SWL2, SWL4, . . . , and SWLn for outputting reference voltage on the low voltage side of floating power supply VSCN2.

Scan pulse voltage applying part 57 has switching element SW3, and connects the reference voltage of odd scan pulse generating part 81 to scan pulse voltage Vad in the address period. Falling gradient voltage generating part 55 gradually decreases the reference voltage of odd scan pulse generating part 81 in the last half of the initializing period.

Composite switch part 90 has switching element SW5, switching element SW6, and switching element SW7. Switching element SW5 connects the reference voltage of odd scan pulse generating part 81 to the output of sustain pulse generating part 51 or rising gradient voltage generating part 53. Switching element SW6 connects the reference voltage of even scan pulse generating part 86 to the output of sustain pulse generating part 51 or rising gradient voltage generating part 53. Switching element SW7 connects the reference voltage of odd scan pulse generating part 81 to the reference voltage of even scan pulse generating part 86.

Floating power supply VSCN1 and floating power supply VSCN2 may be configured using a DC-DC converter or the like, but may be easily configured using a bootstrap circuit having a diode and capacitor. In the present embodiment, both of the voltages of floating power supply VSCN1 and floating power supply VSCN2 are equal to voltage Vscn, so that second voltage Vs2 is equal to (Vad+Vscn), and fourth voltage Vs4 is equal to (Vs3+Vscn). Voltage Vad is −140 (V), voltage Vscn is 148 (V), and third voltage Vs3 is 0 (V). However, these voltages are one example, and are preferably set at optimal values in response to the characteristic or the like of the panel.

Next, an operation of scan electrode driving circuit 43 is described. FIG. 9 is a timing chart for illustrating the operation of scan electrode driving circuit 43 in the unusual charge erasing period in accordance with the exemplary embodiment of the present invention. In the following description, the operation of conducting a switching element is denoted with ON, and the operation of shutting-off denoted with OFF.

Voltage 0 (V) is previously applied to scan electrodes SC1 through SCn. Switching element SW2 of sustain pulse generating part 51, switching element SW5 and switching element SW6 of composite switch part 90, and switching elements SWL1 through SWLn of output parts OUT1 through OUTn are set at ON, and the other switching elements are set at OFF.

At time t1, switching element SW2 of sustain pulse generating part 51 is set at OFF, and switching element SW1 is set at ON. Then, voltage Vm is applied to scan electrodes SC1 through SCn through switching element SW1, switching element SW5 or switching element SW6, and switching elements SWL1 through SWLn.

At this time, positive wall voltage is accumulated on scan electrodes SC1 through SCn of a discharge cell having unusual charge, and negative wall voltage is accumulated on sustain electrodes SU1 through SUn. Therefore, the voltage difference between scan electrodes SC1 through SCn and sustain electrodes SU1 through SUn exceeds the discharge start voltage to cause discharge. Negative wall voltage is accumulated on scan electrodes SC1 through SCn, and positive wall voltage is accumulated on sustain electrodes SU1 through SUn. At time t2, switching element SW1 of sustain pulse generating part 51 is set at OFF, switching element SW2 is set at ON, and scan electrodes SC1 through SCn are temporarily returned to voltage 0 (V). The period from time t2 to time t1 is the period when positive rectangular waveform voltage Vm is applied to scan electrodes SC1 through SCn, namely period TA.

Then, at time t3, switching element SW2 is set at OFF, switching element SW5 and switching element SW6 of composite switch part 90 are set at OFF, switching element SW7 is set at ON, and switching element SW3 of scan pulse voltage applying part 57 is set at ON. Then, voltage Vad is applied to scan electrodes SC1 through SCn via switching element SW3 and switching elements SWL1 through SWLn.

In the discharge cell where discharge occurs after time t1, the voltage difference between scan electrodes SC1 through SCn and sustain electrodes SU1 through SUn exceeds the discharge start voltage again, thereby causing discharge. At this time, the voltage applied to sustain electrodes SU1 through SUn is voltage 0 (V), and the voltage difference between scan electrodes SC1 through SCn and sustain electrodes SU1 through SUn does not greatly exceed the discharge start voltage. Therefore, the wall voltages on scan electrodes SC1 through SCn and sustain electrodes SU1 through SUn are erased.

While, in a normal discharge cell on which unusual charge is not accumulated, only voltage of the discharge start voltage or lower is applied, hence discharge does not occur, and the wall voltage after the completion of the initializing period is kept.

At time t4, switching elements SWL1 through SWLn of output parts OUT1 through OUTn are set at OFF, switching elements SWH1 through SWHn are set at ON, and second voltage Vs2 is applied to scan electrodes SC1 through SCn. The second voltage Vs2 is formed by overlaying voltage Vscn on scan pulse voltage Vad. The period from time t4 to time t3 is the period when negative rectangular waveform voltage Vad is applied to scan electrodes SC1 through SCn, namely period TB. The period after time t4 is address period.

The specific numerical values or the like used in the present embodiment are just one example, and are preferably set at optimal values in response to the characteristic of the panel, specification of the plasma display device, and the like.

As is clear from the above-mentioned descriptions, the present invention can provide a plasma display device that does not cause false lighting in a large temperature range and does not significantly reduce the image display quantity, and a driving method of the plasma display device.

INDUSTRIAL APPLICABILITY

The present invention is useful as a driving method of a plasma display device, because it does not cause false lighting in a large temperature range and does not significantly reduce the image display quantity.

What is claimed is:

1. A driving method of a plasma display device, the plasma display device including:

a plasma display panel having a plurality of discharge cells, each of the discharge cells having a display electrode pair that includes a scan electrode and a sustain electrode; and a temperature detecting circuit for detecting an ambient temperature of the plasma display panel and outputting the detected temperature, wherein the plasma display device displays an image by forming one field period by arranging a plurality of subfields, each of the subfields having:

an initializing period for causing initializing discharge in the discharge cell;

an address period for causing address discharge in the discharge cell; and a sustain period for causing sustain discharge in the discharge cell, the method comprising:

setting an unusual charge erasing period where a rectangular waveform voltage is applied to the scan electrode, between the initializing period and the address period in a number of the plurality of subfields; and controlling the number of subfields having the unusual charge erasing period based on a detected temperature detected by the temperature detecting circuit, wherein during the unusual charge erasing period:

a positive rectangular waveform voltage is applied to the scan electrode followed by a negative rectangular waveform voltage that is applied to the scan electrode; and a duration of the positive rectangular waveform voltage is set longer than a duration of the sustain pulse in the sustain period.

2. The driving method of the plasma display device of claim 1, wherein the unusual charge erasing period is set in more subfields when the detected temperature is low than when the detected temperature is high.

3. The driving method of the plasma display device of claim 1, wherein the unusual charge erasing period is set in the subfield arranged in a second position from a beginning of the plurality of subfields.

4. A plasma display device comprising:

a plasma display panel having a plurality of discharge cells, each of the discharge cells having a display electrode pair that includes a scan electrode and a sustain electrode;

a temperature detecting circuit for detecting an ambient temperature of the plasma display panel and outputting the detected temperature; and a panel driving circuit for displaying an image by forming one field period by arranging a plurality of subfields, each of the subfields having:

an initializing period for causing initializing discharge in the discharge cell;

an address period for causing address discharge in the discharge cell; and a sustain period for causing sustain discharge in the discharge cell, wherein the panel driving circuit sets an unusual charge erasing period where a rectangular waveform voltage is applied to the scan electrode, between the initializing period and the address period in a number of the plurality of subfields, and the panel driving circuit controls the number of subfields having the unusual charge erasing period based on a detected temperature detected by the temperature detecting circuit, wherein during the unusual charge erasing period;

a positive rectangular waveform voltage is applied to the scan electrode followed by a negative rectangular waveform voltage that is applied to the scan electrode, and a duration of the positive rectangular waveform voltage is set longer than a duration of the sustain pulse in the sustain period.

* * * * *